US010066643B2

(12) United States Patent
Coppedge et al.

(10) Patent No.: US 10,066,643 B2
(45) Date of Patent: Sep. 4, 2018

(54) MULTIPLE GAS GENERATOR DRIVEN PRESSURE SUPPLY

(71) Applicant: Bastion Technologies, Inc., Houston, TX (US)

(72) Inventors: Charles Don Coppedge, Houston, TX (US); Joseph Reeves, League City, TX (US); Jayant Ramakrishnan, Houston, TX (US); Jorge Hernandez, Houston, TX (US)

(73) Assignee: Bastion Technologies, Inc., Houston, TX (US)

( * ) Notice: Subject to any disclaimer, the term of this patent is extended or adjusted under 35 U.S.C. 154(b) by 19 days.

(21) Appl. No.: 14/941,233

(22) Filed: Nov. 13, 2015

(65) Prior Publication Data

US 2016/0138617 A1 May 19, 2016

Related U.S. Application Data

(60) Provisional application No. 62/079,447, filed on Nov. 13, 2014.

(51) Int. Cl.

| | |
|---|---|
| ***F15B 1/08*** | (2006.01) |
| ***F15B 11/08*** | (2006.01) |
| ***E21B 33/064*** | (2006.01) |

(52) U.S. Cl.

CPC ..... *F15B 1/08* (2013.01); *E21B 33/064* (2013.01); *F15B 11/08* (2013.01); *F15B 2201/00* (2013.01)

(58) Field of Classification Search

CPC ..... F15B 1/08; F15B 33/064; F15B 11/08; F15B 2201/00

USPC ..... 60/634

See application file for complete search history.

(56) References Cited

U.S. PATENT DOCUMENTS

| | | | | |
|---|---|---|---|---|
| 2,979,094 | A | 4/1961 | Royer | |
| 3,018,627 | A * | 1/1962 | Perricci | B64C 13/24 417/540 |
| 3,031,845 | A | 5/1962 | Ludwig | |
| 3,077,077 | A | 2/1963 | Jones | |
| 3,100,058 | A | 8/1963 | Peet | |
| 3,100,965 | A | 8/1963 | Blackburn | |

(Continued)

FOREIGN PATENT DOCUMENTS

| | | |
|---|---|---|
| CN | 100419214 C | 9/2008 |
| CN | 101377150 B | 6/2012 |

(Continued)

OTHER PUBLICATIONS

International Search Report and Written Opinion for PCT/US201515/060930, Monopropellant, dated Feb. 2, 2016.

(Continued)

*Primary Examiner* — Patrick Maines
(74) *Attorney, Agent, or Firm* — Winstead PC

(57) ABSTRACT

A pressure supply device in accordance to one or more aspects includes an elongated body having an internal bore extending from a power end to a discharge end having a discharge port, two or more gas generators connected to the power end and a hydraulic fluid disposed in the bore between a piston and the discharge end. The ignition of one of the gas generators drives the piston to exhaust a partial volume of the hydraulic fluid that is less than the total operational volume of the hydraulic fluid under pressure to operate at a connected device.

20 Claims, 13 Drawing Sheets

(56) References Cited

U.S. PATENT DOCUMENTS

| | | | | |
|---|---|---|---|---|
| 3,236,046 | A | 2/1966 | Wellman | |
| 3,286,460 | A * | 11/1966 | Stadler | B21J 7/26 60/634 |
| 3,858,392 | A * | 1/1975 | Evans | F02G 3/00 102/531 |
| 3,886,745 | A | 6/1975 | Kaida et al. | |
| 3,933,338 | A | 1/1976 | Herd et al. | |
| 4,074,527 | A | 2/1978 | Sadler | |
| 4,163,477 | A | 8/1979 | Johnson et al. | |
| 4,308,721 | A * | 1/1982 | Thomas | F15B 1/08 60/325 |
| 4,412,419 | A | 11/1983 | Thomas et al. | |
| 4,461,322 | A | 7/1984 | Mills | |
| 4,619,111 | A | 10/1986 | Whiteman | |
| 4,753,151 | A * | 6/1988 | Peterson | B64D 1/02 244/137.1 |
| 4,777,800 | A | 10/1988 | Hay, II | |
| 4,815,295 | A * | 3/1989 | Narum | E21B 33/0355 60/632 |
| 5,004,154 | A | 4/1991 | Yoshida et al. | |
| 5,072,896 | A | 12/1991 | McIntyre et al. | |
| 5,316,087 | A | 5/1994 | Manke et al. | |
| 5,481,977 | A | 1/1996 | Evans et al. | |
| 5,647,734 | A | 7/1997 | Milleron | |
| 6,202,753 | B1 | 3/2001 | Baugh | |
| 6,418,970 | B1 | 7/2002 | Deul | |
| 6,817,298 | B1 | 11/2004 | Zharkov et al. | |
| 7,011,722 | B2 | 3/2006 | Amtower, II | |
| 7,231,934 | B2 | 6/2007 | Biester | |
| 7,721,652 | B2 | 5/2010 | Yoshida et al. | |
| 7,810,569 | B2 | 10/2010 | Hill et al. | |
| 8,453,575 | B2 | 6/2013 | Humbert et al. | |
| 8,616,128 | B2 | 12/2013 | Sampson | |
| 8,783,357 | B2 | 7/2014 | Coppedge et al. | |
| 9,212,103 | B2 | 12/2015 | Coppedge et al. | |
| 9,856,889 | B2 | 1/2018 | Wilie | |
| 2004/0089450 | A1 | 5/2004 | Slade et al. | |
| 2009/0178433 | A1 | 7/2009 | Kumakura et al. | |
| 2009/0211239 | A1 | 8/2009 | Askeland | |
| 2010/0024420 | A1 * | 2/2010 | Dreyer | B60R 21/38 60/632 |
| 2010/0206389 | A1 | 8/2010 | Kennedy et al. | |
| 2011/0108285 | A1 | 5/2011 | Fagley, IV et al. | |
| 2011/0284237 | A1 | 11/2011 | Baugh | |
| 2012/0048566 | A1 | 3/2012 | Coppedge et al. | |
| 2012/0111572 | A1 | 5/2012 | Cargo, Jr. | |
| 2013/0220161 | A1 * | 8/2013 | Coppedge | C06D 5/00 102/531 |

FOREIGN PATENT DOCUMENTS

| | | | |
|---|---|---|---|
| DE | 102007001645 | A1 | 7/2008 |
| EP | 0009346 | A1 | 4/1980 |

OTHER PUBLICATIONS

International Search Report and Written Opinion for PCT/US2015/060679, Multiple, dated Mar. 2, 2016.

International Search Report and Written Opinion for PCT/US2013/027680, Pyrotechnic Pressure Accumulator, dated May 8, 2013.

International Search Report and Written Opinion for PCT/US201327680 dated May 8, 2013.

Extended European Search Report in EP Appl. No. 13751969.0, National Phase of PCT/US201327689 dated Oct. 22, 2015.

* cited by examiner

MULTIPLE GAS GENERATOR DRIVEN PRESSURE SUPPLY

BACKGROUND

This section provides background information to facilitate a better understanding of the various aspects of the disclosure. It should be understood that the statements in this section of this document are to be read in this light, and not as admissions of prior art.

Pre-charged hydraulic accumulators are utilized in many different industrial applications to provide a source of hydraulic pressure and operating fluid to actuate devices such as valves. It is common for installed pre-charged hydraulic accumulators to be connected to or connectable to a source of hydraulic pressure to recharge the hydraulic accumulator due to leakage and/or use.

SUMMARY

A pressure supply device in accordance to one or more aspects includes an elongated body having an internal bore extending from a power end to a discharge end having a discharge port, two or more gas generators connected to the power end and a hydraulic fluid disposed in the bore between a piston and the discharge end. The ignition of one of the gas generators drives the piston to exhaust a partial volume of the hydraulic fluid that is less than the total operational volume of the hydraulic fluid under pressure to operate at a connected device. In accordance to a method a first volume of pressurized hydraulic fluid is exhausted through a discharge port of a pressure supply device in response to igniting a first gas generator and a second volume of pressurized hydraulic fluid is exhausted in response to igniting a second gas generator. An operational device may be actuated to a first position in response to receiving the first volume of pressurized hydraulic fluid or in response to receiving the first and the second volumes of pressurized hydraulic fluid.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
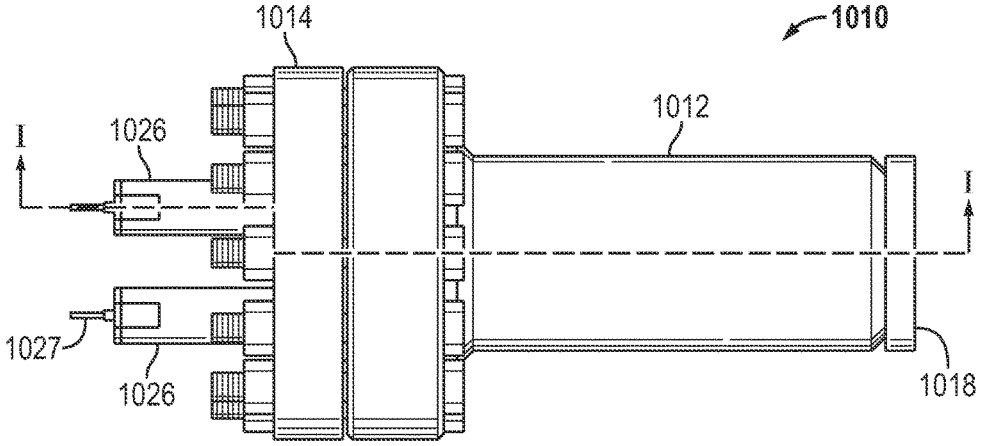
FIGS. 1 and 3 illustrate multiple gas generator driven pressure supply devices according to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

A gas generator driven pressure supply device is disclosed that provides a useable storage of hydraulic fluid that can be pressurized for use on demand. The gas generator driven pressure supply device can be utilized to establish the necessary hydraulic power to drive and operate hydraulic and mechanical operational devices and systems and it may be utilized in conjunction with or in place of pre-charged hydraulic accumulators. Examples of utilization of the gas generator driven pressure supply device are described with reference to well systems, in particular safety systems; however, use of the gas generator driven pressure supply devices is not limited to well systems, subsea systems and environments or to safety systems. For example, and without limitation, gas generator driven pressure supply devices are utilized to operate valves, bollards, pipe rams, and pipe shears. According to embodiments disclosed herein, the gas generator driven pressure supply device can be located subsea and remain in place without requiring hydraulic pressure recharging.

Figure 2:
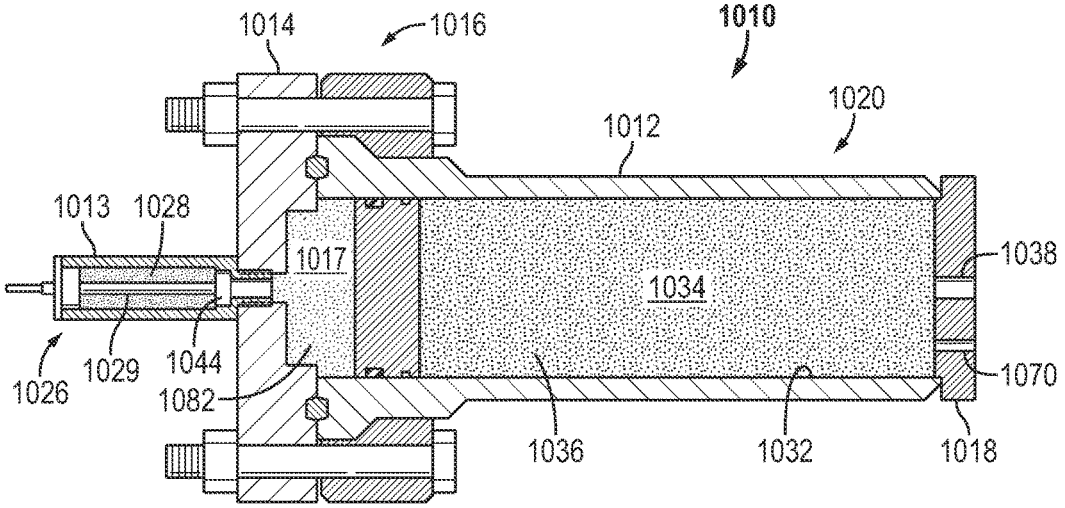
FIG. 2 is a sectional view of a multiple gas generator driven pressure supply device along the line I-I of FIG. 1.
Figure 3:
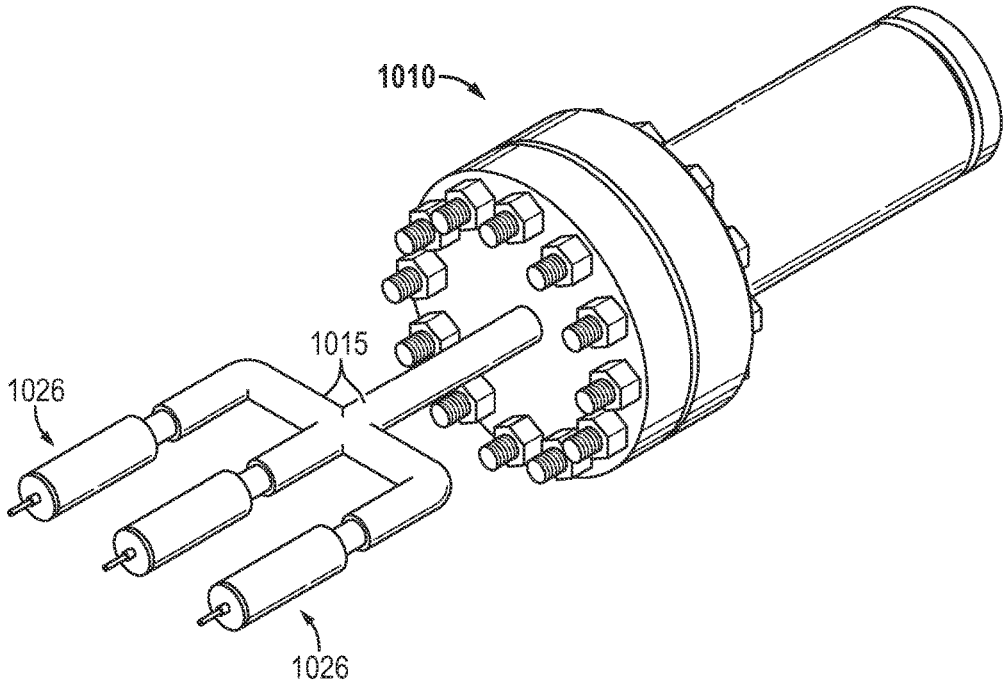

FIGS. 1 and 2 illustrate a gas generator driven pressure supply device, generally denoted by the numeral 1010, in accordance to one or more embodiments. The pressure supply device 1010 is driven by a gas generator 1026 and in particular by multiple gas generators 1026. FIG. 2 is a sectional view of the pressure supply device 1010 along the line I-I in FIG. 1. With reference in particular to FIGS. 1-3, the pressure supply device 1010 has a body 1012 extending axially substantially from a first end 1014, or power end, of a pyrotechnic section 1016 to a discharge end 1018 of a hydraulic section 1020. Body 1012 may be constructed of one or more sections and forms a bore 1032. A piston 1030 is moveably disposed in the bore 1032 and separates a hydraulic chamber 1034 formed between the piston and the discharge end from a gas chamber 1017 on the opposite side of the piston. The hydraulic chamber 1034 is filled with a fluid 1036, e.g., non-compressible fluid, e.g., oil, water, or gas. Fluid 1036 is generally described herein as a liquid or hydraulic fluid, however, it is understood that a gas can be utilized for some embodiments. Fluid 1036 is not pre-charged and stored in hydraulic chamber 1034 at the operating pressure, but instead driven to the required operating pressure by gas generators 1026. Hydraulic chamber 1034 can be filled with fluid 1036 for example through the discharge port 1038 located at the discharge end 1018 of the bore. A relief port 1070 is illustrated in FIG. 2 through which can be utilized to relieve pressure from the hydraulic chamber during fluid fill operations. The location of vent port 1070 can vary. As will be understood by those skilled in the art with benefit of this disclosure port 1070 will include a valve or plug during operations.

Multiple pressure generators 1026 (i.e., gas generators), comprising a pyrotechnic (e.g., propellant) charge 1028, is connected at first end 1014 and is in communication with the gas chamber 1017 (i.e., expansion chamber) of pyrotechnic section 1016. The propellant may be for example a solid propellant. The depicted pressure generator 1026 comprises an initiator (e.g., ignitor) 1029 connected to the charge 1028 and extending via an electrical conductor to an electrical connector 1027. Upon ignition of pyrotechnic charge 1028, high pressure gas 1082 is produced and expands in gas chamber 1017 and urges piston 1030 toward discharge end 1018 thereby pressurizing fluid 1036 and exhausting the pressurized fluid through discharge end 1018 to operate the connected operational device.

With reference to FIGS. 1-4, the gas generators 1026 are formed as cartridges with the propellant 1028 located in a breech chamber 1044 of a housing 1013. The breech chamber is in fluid connection or communication with the gas chamber 1017. In FIG. 2, the housing 1013 is connected directly to the body 1012 for example by threading. In FIG. 3 the gas generators 1026 are connected to body via a manifold or conduit 1015. As will be noted the gas generators 1026 are operationally connected to the pressure supply device in parallel and can be operated independent of one another.

Figure 4:
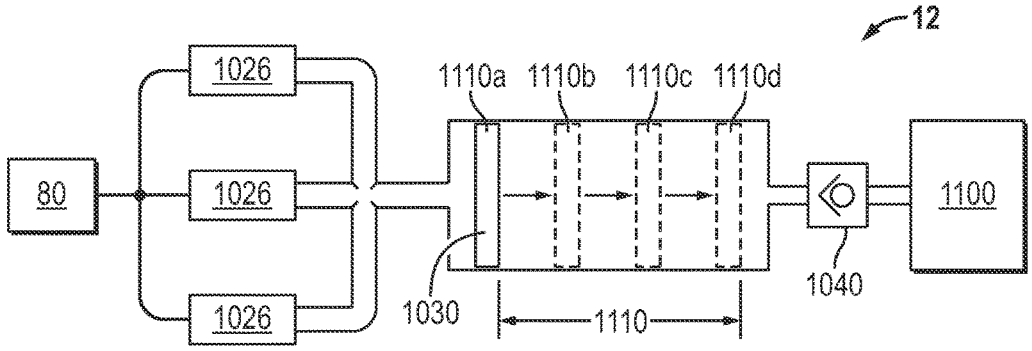
FIG. 4 is a schematic illustration of a well system incorporating a multiple gas generator driven pressure supply device according to one or more aspects of the disclosure.

Operation of a multiple gas generator driven pressure supply device 1010 in a well system 12 is now described with reference to FIG. 4. Well system 12, which may be a land based or subsea well system, includes an operational device 1100 that is operated in response to hydraulic pressure. Operational device 1100 may include without limitation devices and tools such as valves, rams, and shears. The operational device may be disposed in a wellbore or be in operational connection or communication with a wellbore, for example to a tubular that extends into the wellbore. The operational devices 1100 may be operated between two or more positions, for example, in some embodiments a device may be operated through various open flow positions. FIG. 4 illustrates the piston 1030 being moved in sequential steps along the stroke length 1110 of the pressure supply device in response to sequential ignition of the multiple gas generators 1026. For example, a signal may be sent from controller 80 to a first one of the multiple gas generators 1026 and in response to ignition of the first gas generator the piston moves from a first position 1110*a* to a second position 1110*b*. The movement of the piston forces a volume of the hydraulic fluid out of the discharge port 1038 through the flow control device 1040 and to the operational device 1100. The first volume of hydraulic fluid discharged may actuate the operational device to a first position or an additional volume of hydraulic fluid may be needed to actuate the operational device 1100, for example the first and second volumes of pressurized hydraulic fluid may be required to actuate the device 1100 to a first position. The controller 80 may ignite a second gas generator 1026 to move the piston from the second position 1110*b* to position 1110*c* as needed. Similarly, the controller can operate the third gas generator to move the piston from the third position to a fourth position 1110*d*. Multiple gas generators 1026 may be utilized as opposed to a single gas generator for various purposes. As noted, in some systems 12 the operational device 1100 may be operable between two or more positions. Accordingly, the pressure supply device 1010 may contain a sufficient volume of hydraulic fluid for two or more actuations of a single operational device 1100 or to actuate more than one operational device. Multiple gas generators may also provide for a safety backup, for example, if a first gas generator does not ignite or does not move the piston a sufficient distance to provide the volume and/or pressure of hydraulic fluid required, then a second gas generator can be actuated.

As will be understood by those skilled in the art with benefit of this disclosure, multiple gas generators 1026 may be utilized various pressure supply device configurations. For example, FIGS. 5-9, illustrate and describe embodiments of pressure supply devices 1010 with relation to a single gas generator 1026 as disclosed in U.S. Published Patent Application 2013/0220161, which is incorporated herein by reference.

Figure 5:
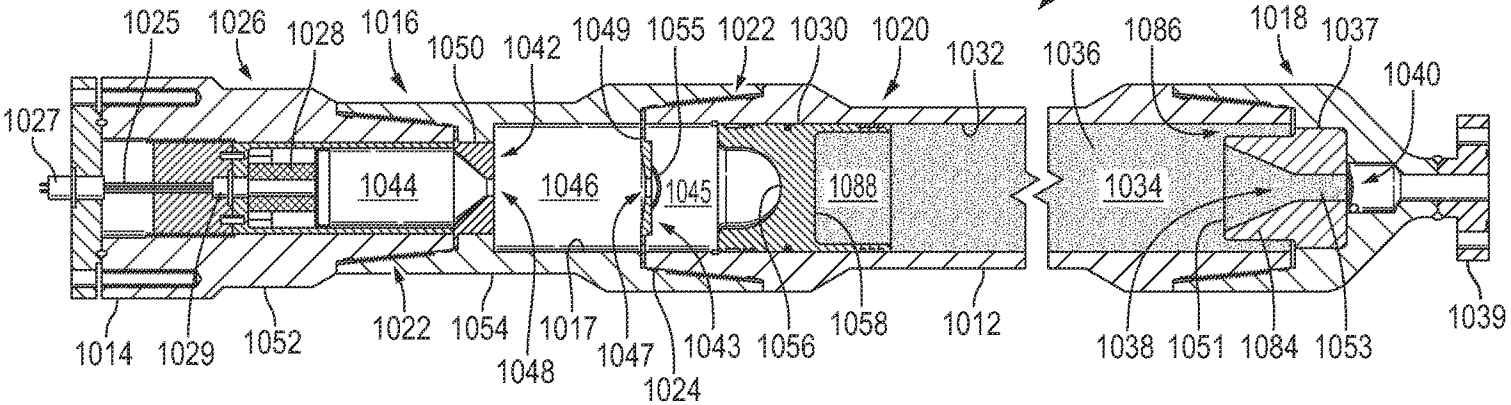
FIG. 5 illustrates an example of a pressure supply device according to one or more aspects of the disclosure that can be utilized as a multiple gas generator driven pressure supply device.
Figure 6:
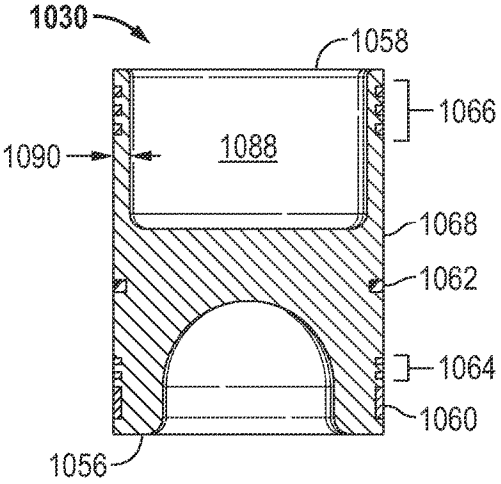
FIG. 6 illustrates a piston according to an embodiment of the disclosure.

FIG. 5 is a sectional view of an example of a pressure supply device 1010 according to one or more embodiments. Pressure supply device 1010 comprises an elongated body 1012 extending substantially from a first end 1014 of pyrotechnic section 1016 to a discharge end 1018 of a hydraulic section 1020. As will be understood by those skilled in the art with benefit of this disclosure, body 1012 may be constructed of one or more sections (e.g., tubular sections). In the depicted embodiment, pyrotechnic section 1016 and hydraulic section 1020 are connected at a threaded joint 1022 (e.g., double threaded) having a seal 1024. In the depicted embodiment, threaded joint 1022 provides a high pressure seal (e.g., hydraulic seal and/or gas seal).

A pressure generator 1026 (i.e., gas generator), comprising a pyrotechnic (e.g., propellant) charge 1028, is connected at first end 1014 (e.g., power end) and is in communication with the gas chamber 1017 (i.e., expansion chamber) of pyrotechnic section 1016. The depicted pressure generator 1026 comprises an initiator (e.g., igniter) 1029 connected to pyrotechnic charge 1028 and extending via electrical conductor 1025 to an electrical connector 1027. In this example, electrical connector 1027 is a wet-mate connector for connecting to an electrical source for example in a sub-sea, high pressure environment.

A piston 1030 is moveably disposed within a bore 1032 of the hydraulic section 1020 of body 1012. A hydraulic fluid chamber 1034 is formed between piston 1030 and discharge end 1018. Hydraulic chamber 1034 is filled with a fluid 1036, e.g., non-compressible fluid, e.g., oil, water, or gas. Fluid 1036 is generally described herein as a liquid or hydraulic fluid, however, it is understood that a gas can be utilized for some embodiments. Hydraulic chamber 1034 can be filled with fluid 1036 for example through a port. Fluid 1036 is not pre-charged and stored in hydraulic chamber 1034 at the operating pressure.

A discharge port 1038 is in communication with discharge end 1018 to communicate the pressurized fluid 1036 to a hydraulic circuit having an operational device (e.g., valve, rams, bollards, etc.). In the depicted embodiment, discharge port 1038 is formed by a member 1037, referred to herein as cap 1037, connected at discharge end 1018 for example by a bolted flange connection. A flow control device 1040 is located in the fluid flow path of discharge port 1038. In this example, flow control device 1040 is a one-way valve (i.e., check valve) permitting fluid 1036 to be discharged from fluid hydraulic chamber 1034 and blocking backflow of fluid into hydraulic chamber 1034. A connector 1039 (e.g., flange) is depicted at discharge end 1018 to connect hydraulic chamber 1034 to an operational device for example through a manifold. According to embodiments, pressure supply device 1010 is configured to be connected to a subsea well system for example by a remote operated vehicle.

Upon ignition of pyrotechnic charge 1028, high pressure gas is produced and expands in gas chamber 1017 and urges piston 1030 toward discharge end 1018 thereby pressurizing fluid 1036 and exhausting the pressurized fluid 1036 through discharge end 1018 and flow control device 1040 to operate the connected operational device.

Piston 1030 is configured to operate in a pyrotechnic environment and in a hydraulic environment. A non-limiting example of piston 1030, referred to also as a hybrid piston, is described with reference to FIGS. 5 and 6. Piston 1030, depicted in FIGS. 5 and 6, includes a pyrotechnic end, or end section, 1056 and a hydraulic end, or end section 1058. Pyrotechnic end 1056 faces pyrotechnic charge 1028 and hydraulic end 1058 faces discharge end 1018. Piston 1030 may be constructed of a unitary body or may be constructed in sections (see, e.g., FIGS. 7-9) of the same or different material. In this embodiment, piston 1030 comprises a ballistic seal (i.e., obturator seal) 1060, a hydraulic seal 1062, and a first and a second piston ring set 1064, 1066. According to an embodiment, ballistic seal 1060 is located on outer surface 1068 of pyrotechnic end 1056 of piston 1030. Ballistic seal 1060 may provide centralizing support for piston 1030 in bore 1032 and provide a gas seal to limit gas blow by (e.g., depressurization). First piston ring set 1064 is located adjacent to ballistic seal 1060 and is separated from the terminal end of pyrotechnic end 1056 by ballistic seal 1060. Second piston ring set 1066 is located proximate the terminal end of hydraulic end section 1058. A hydraulic seal 1062 is located between the first piston ring set and the second piston ring set in this non-limiting example of piston 1030.

According to some embodiments, one or more pressure control devices 1042 are positioned in gas chamber 1017 for example to dampen the pressure pulse and/or to control the pressure (i.e., operating or working pressure) at which fluid 1036 is exhausted from discharge port 1038. In the embodiment depicted in FIG. 5, gas chamber 1017 of pyrotechnic section 1016 includes two pressure control devices 1042, 1043 dividing gas chamber 1017 into three chambers 1044, 1046 and 1045. First chamber 1044, referred to also as breech chamber 1044, is located between first end 1014 (e.g., the connected gas generator 1026) and first pressure control device 1042 and a snubbing chamber 1046 is formed between pressure control devices 1042, 1043. Additional snubbing chambers can be provided when desired.

First pressure control device 1042 comprises an orifice 1048 formed through a barrier 1050 (e.g., orifice plate). Barrier 1050 may be constructed of a unitary portion of the body of pyrotechnic section 1016 or it may be a separate member, see e.g. FIGS. 1-3, connected with pyrotechnic section. Second pressure control device 1043 comprises an orifice 1047 formed through a barrier 1049. Barrier 1049 may be a continuous or unitary portion of the body of pyrotechnic section 1016 or may be a separate member connected within the pyrotechnic section. The size of orifices 1048, 1047 can be sized to provide the desired working pressure of the discharged hydraulic fluid 1036.

Figure 7:
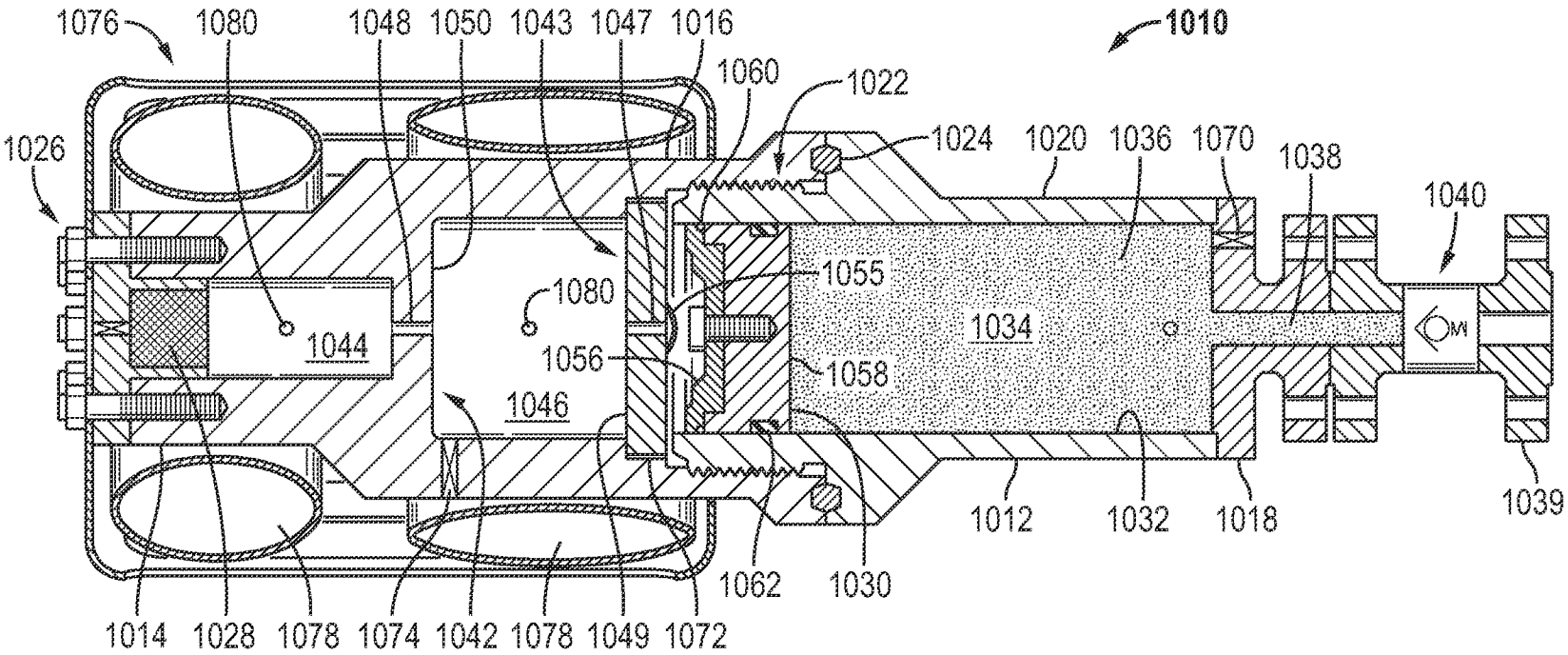
FIGS. 7-9 illustrate an example of a pressure supply device in various positions that can be utilized as a multiple gas generator driven pressure supply device.
Figure 8:
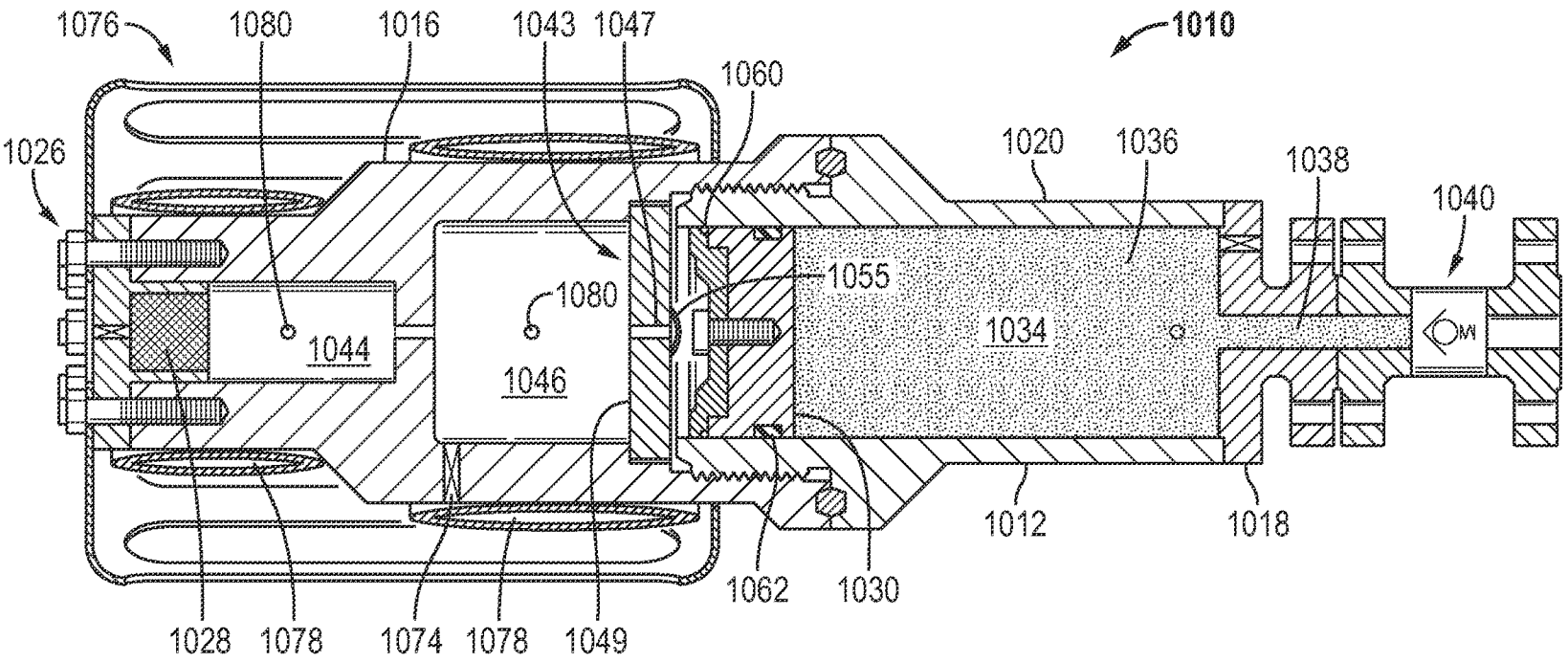
Figure 9:
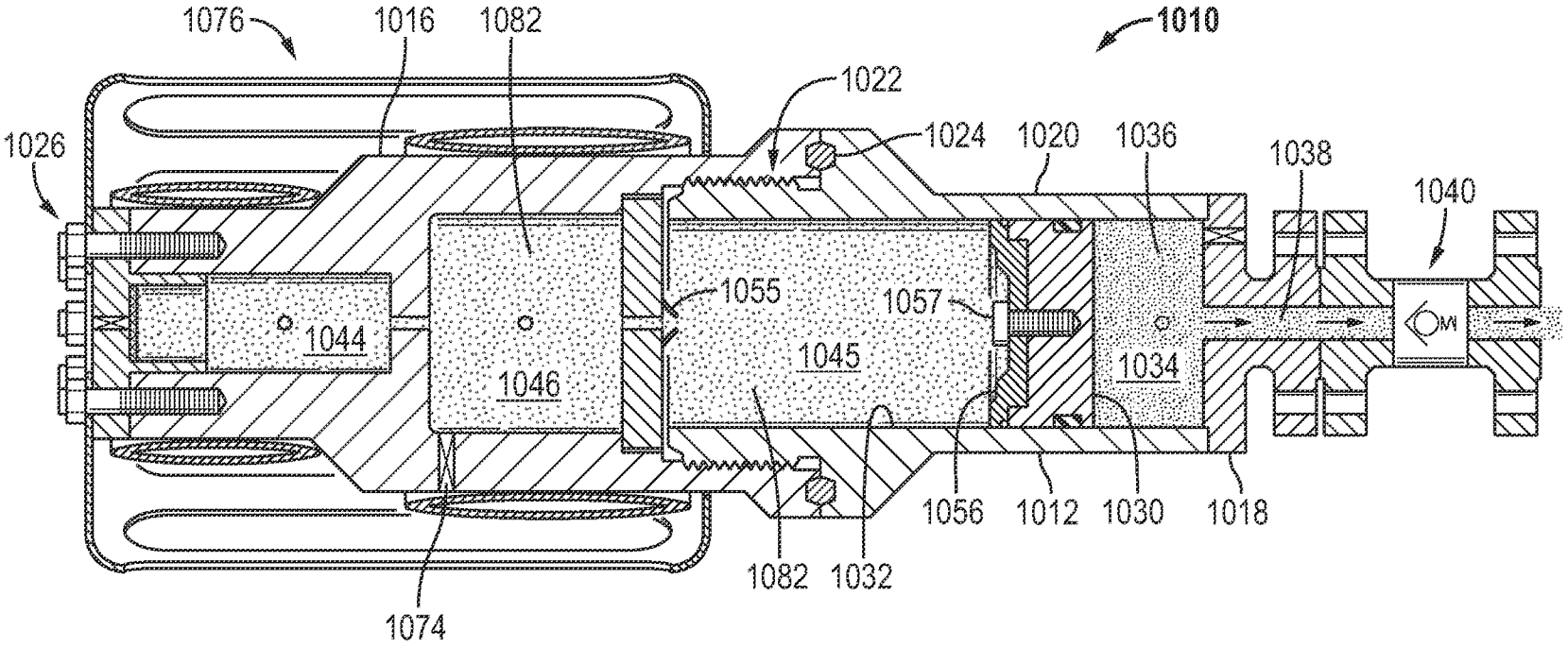

For example, in FIG. 5 pyrotechnic section 1016 includes two interconnected tubular sections or subs. In this embodiment, the first tubular sub 1052 (e.g., breech sub), includes first end 1014 and breech chamber 1044. The second tubular sub 1054, also referred to as snubbing sub 1054, forms snubbing chamber 1046 between the first pressure control device 1042, i.e., breech orifice, and the second pressure control device 1043, i.e., snubbing orifice. For example, piston 1030 and snubbing pressure control device 1043 may be inserted at the threaded joint 1022 between hydraulic section 1020 and snubbing sub 1054 as depicted in FIG. 5, formed by a portion of body 1012, and or secured for example by soldering or welding as depicted in FIGS. 7-9 (e.g., connector 1072, FIG. 7). The breech pressure control device 1042 can be inserted at the threaded joint 1022 between breech sub 1052 and snubbing sub 1054. In the FIG. 5 embodiment, barrier 1050 and/or barrier 1049 may be retained between the threaded connection 1022 of adjacent tubular sections of body 1012 and/or secured for example by welding or soldering (e.g., connector 1072 depicted in FIG. 7).

In the embodiment of FIG. 5, a rupture device 1055 closes an orifice 1048, 1047 of at least one of pressure control devices 1042, 1043. In the depicted example, rupture device 1055 closes orifice 1047 of second pressure control device 1043, adjacent to hydraulic section 1020, until a predetermined pressure differential across rupture device 1055 is achieved by the ignition of pyrotechnic charge 1028. Rupture device 1055 provides a seal across orifice 1047 prior to connecting pyrotechnic section 1016 with hydraulic section 1020 and during inactivity, for example to prevent fluid 1036 leakage to seep into pyrotechnic section 1016.

According to some embodiments, a pressure compensation device (see, e.g., FIGS. 7-9) may be connected for example with gas chamber 1017 of pyrotechnic section 1016. When being located subsea, the pressure compensation device substantially equalizes the pressure in gas chamber 1017 with the environmental hydrostatic pressure. In accordance to some embodiments, the pressure supply devices do not utilized a pressure compensation device.

According to one or more embodiments, pressure supply device 1010 may provide a hydraulic cushion to mitigate impact of piston 1030 at discharge end 1018, for example against cap 1037. In the example depicted in FIG. 5, the cross-sectional area of discharge port 1038 decreases from an inlet end 1051 to the outlet end 1053. The tapered discharge port 1038 may act to reduce the flow rate of fluid 1036 through discharge port 1038 as piston 1030 approaches discharge end 1018 and providing a fluid buffer that reduces the impact force of piston 1030 against cap 1037.

A hydraulic cushion at the end of the stroke of piston 1030 may be provided for example, by a mating arrangement of piston 1030 and discharge end 1018 (e.g., cap 1037). For example, as illustrated in FIG. 5 and with additional reference to FIG. 6, end cap 1037 includes a sleeve section 1084 disposed inside of bore 1032 of hydraulic section 1020. Sleeve section 1084 has a smaller outside diameter than the inside diameter of bore 1032 providing an annular gap 1086. Piston 1030 has a cooperative hydraulic end 1058 that forms a cavity 1088 having an annular sidewall 1090 (e.g., skirt). Annular sidewall 1090 is sized to fit in annular gap 1086 disposed inlet end 1051 and sleeve 1084 in cavity 1088. Hydraulic fluid 1036 disposed in gap 1086 will cushion the impact of piston 1030 against end cap 1037. It is to be noted that discharge port 1038 does not have to be tapered to provide a hydraulic cushion.

In some embodiments (e.g., see FIGS. 7-9), hydraulic chamber 1034 may be filled with a volume of hydraulic fluid 1036 in excess of the volume required for the particular installation of pressure supply device 1010. The excess volume of fluid 1036 can provide a cushion separating piston 1030 from discharge end 1018 at the end of the stroke of piston 1030.

FIG. 7 is a sectional view of a pressure supply device 1010 according to one or more embodiments illustrated in a first position for example prior to being deployed at a depth subsea. Pressure supply device 1010 comprises an elongated body 1012 extending from a first end 1014 of a pyrotechnic section 1016 to discharge end 1018 of a hydraulic section 1020. In the depicted example pyrotechnic section 1016 and hydraulic section 1020 are connected at a threaded joint 1022 having at least one seal 1024.

Hydraulic section 1020 comprises a bore 1032 in which a piston 1030 is movably disposed. The piston 1030 depicted in FIGS. 7-9 is a hybrid piston having a pyrotechnic end section 1056 having a ballistic seal 1060 and hydraulic end section 1058 having a hydraulic seal 1062. In the depicted embodiment, piston 1030 is a two-piece construction. Pyrotechnic end section 1056 and hydraulic end section 1058 are depicted coupled together by a connector, generally denoted by the numeral 1057 in FIG. 9. Connector 1057 is depicted as a bolt, e.g., threaded bolt, although other attaching devices and mechanism (e.g., adhesives may be utilized).

Hydraulic chamber 1034 is formed between piston 1030 and discharge end 1018. A flow control device 1040 is disposed with discharge port 1038 of discharge end 1018 substantially restricting fluid flow to one-direction from hydraulic chamber 1034 through discharge port 1038. Hydraulic chamber 1034 may be filled with hydraulic fluid 1036 for example through discharge port 1038. Port 1070 (e.g., valve) is utilized to relieve pressure from hydraulic chamber 1034 during fill operations or to drain fluid 1036 for example if an un-actuated pressure supply device 1010 is removed from a system.

In some embodiments, pyrotechnic section 1016 includes the breech chamber 1044 (e.g., the gas generator) and a snubbing chamber 1046. Gas generator 1026 is illustrated connected, for example by bolted interface in FIGS. 5, 7-9, to first end 1014 disposing pyrotechnic charge 1028 into breech chamber 1044. Breech chamber 1044 and snubbing chamber 1046 are separated by pressure control device 1042 which is illustrated as an orifice 1048 formed through breech barrier 1050. In this non-limiting example, breech barrier 1050 is formed by a portion of body 1012 forming pyrotechnic section 1016. Breech orifice 1048 can be sized for the desired operating pressure of pressure supply device 1010.

Snubbing chamber 1046 is formed in pyrotechnic section 1016 between barrier 1050 and a snubbing barrier 1049 of second pressure control device 1043. Pressure control device 1043 has a snubbing orifice 1047 formed through snubbing barrier 1049. In FIG. 7 the snubbing barrier 1049 is illustrated secured in place by a connector 1072. In this example, connector 1072 is a solder or weld to secure barrier 1049 (i.e., plate) in place and provide additional sealing along the periphery of barrier 1049. Snubbing orifice 1047 may be sized for the fluid capacity and operating pressure of the particular pressure supply device 1010 for example to dampen the pyrotechnic charge pressure pulse. A rupture device 1055 is depicted disposed with the orifice 1047 to seal the orifice and therefore gas chambers 1044, 1046 during inactivity of the deployed pressure supply device 1010. Rupture device 1055 can provide a clear opening during activation of pressure supply device 1010 and burning of charge 1028. In FIGS. 7-9 a vent 1074, i.e., valve, is illustrated in communication with gas chamber 1017 to relieve pressure from the gas chambers prior to disassembly after pressure supply device 1010 has been operated.

FIGS. 7 to 9 illustrate a pressure compensation device 1076 in operational connection with the gas chambers, breech chamber 1044 and snubbing chamber 1046, to increase the pressure in the gas chambers in response to deploying pressure supply device 1010 subsea. In the depicted embodiment, pressure compensator 1076 includes one or more devices 1078 (e.g. bladders) containing a gas (e.g., nitrogen). Bladders 1078 are in fluid connection with gas chambers 1017 (e.g., chambers 1044, 1046, etc.) for example through ports 1080. In FIG. 8, the pressure supply device 1010 is depicted deployed subsea (see, e.g., FIGS. 11-12) prior to being activated. In response to the hydrostatic pressure at the subsea depth of pressure supply device bladders 1078 have deflated thereby pressurizing breech chamber 1044 and snubbing chamber 1046. Again, in some embodiments pressure compensation devices and systems are not utilized.

FIG. 9 illustrates an embodiment of pressure supply device 1010 after being activated. With reference to FIGS. 8 and 9, pressure supply device 1010 is activated by igniting pyrotechnic charge 1028. The ignition generates gas 1082 which expands in breech chamber 1044 and snubbing chamber 1046. The pressure in the gas chambers ruptures rupture device 1055 and the expanding gas acts on pyrotechnic side 1056 of piston 1030. Piston 1030 is moved toward discharge end 1018 in response to the pressure of gas 1082 thereby discharging pressurized fluid 1036 through discharge port 1038 and flow control device 1040. In FIG. 9, piston 1030 is illustrated spaced a distance apart from discharge end 1018. In accordance to one or more embodiments, at least a portion of the volume of fluid 1036 remaining in hydraulic fluid chamber 1034 is excess volume supplied to provide a space (i.e., cushion) between piston 1030 and discharge end 1018 at the end of the stroke of piston 1030.

Pressure supply device 1010 can be utilized in many applications wherein an immediate and reliable source of pressurized fluid is required. Pressure supply device 1010 provides a sealed system that is resistant to corrosion and that can be constructed of material for installation in hostile environments. Additionally, pressure supply device 1010 can provide a desired operating pressure level without regard to the ambient environmental pressure (i.e., no pressure compensation). Multiple gas generators may be utilized to drive the pressure supply device.

A method of operation is now described with reference to FIGS. 10-13 which illustrate a subsea well system 12 in which one or more pressure supply devices are utilized. The pressure supply devices and systems of FIGS. 5-13 are disclosed in U.S. Patent Application Publication No. 2013/0220161, which is incorporated herein by reference.

Figure 10:
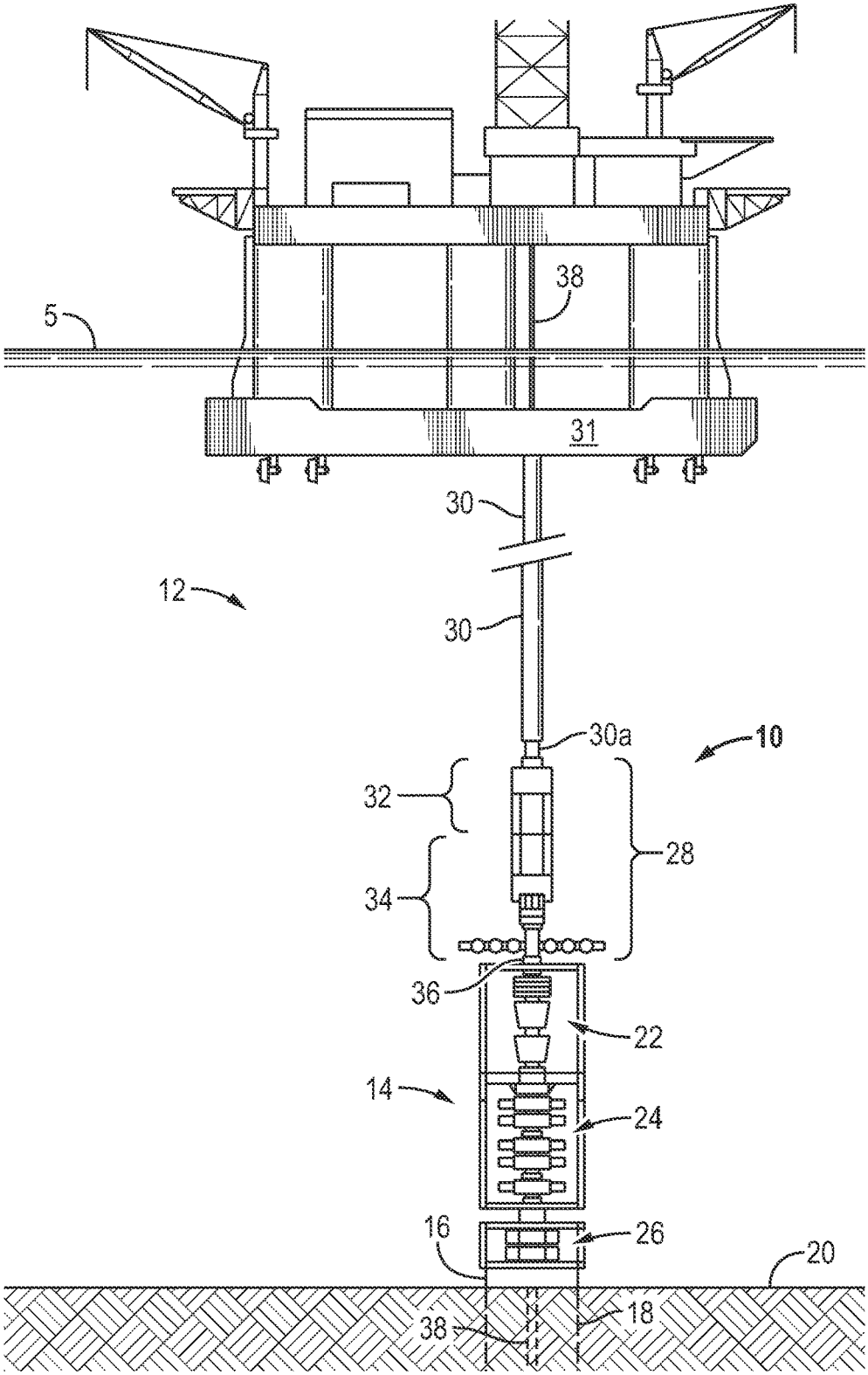
FIGS. 10 and 11 illustrate a subsea well system and subsea well safety system in which multiple gas generator driven pressure supply devices can be utilized.

FIG. 10 is a schematic illustration of a well safing system, generally denoted by the numeral 10, being utilized in a subsea well system 12. The depicted subsea well system is a non-limiting example of a system in which the multiple gas generator driven pressure supply device may be utilized. In the depicted embodiment drilling system 12 includes a BOP stack 14 which is landed on a subsea wellhead 16 of a well 18 (i.e., wellbore) penetrating seafloor 20. BOP stack 14 conventionally includes a lower marine riser package ("LMRP") 22 and blowout preventers ("BOP") 24. The depicted BOP stack 14 also includes subsea test valves ("SSTV") 26. As will be understood by those skilled in the art with benefit of this disclosure, BOP stack 14 is not limited to the devices depicted.

Figure 11:
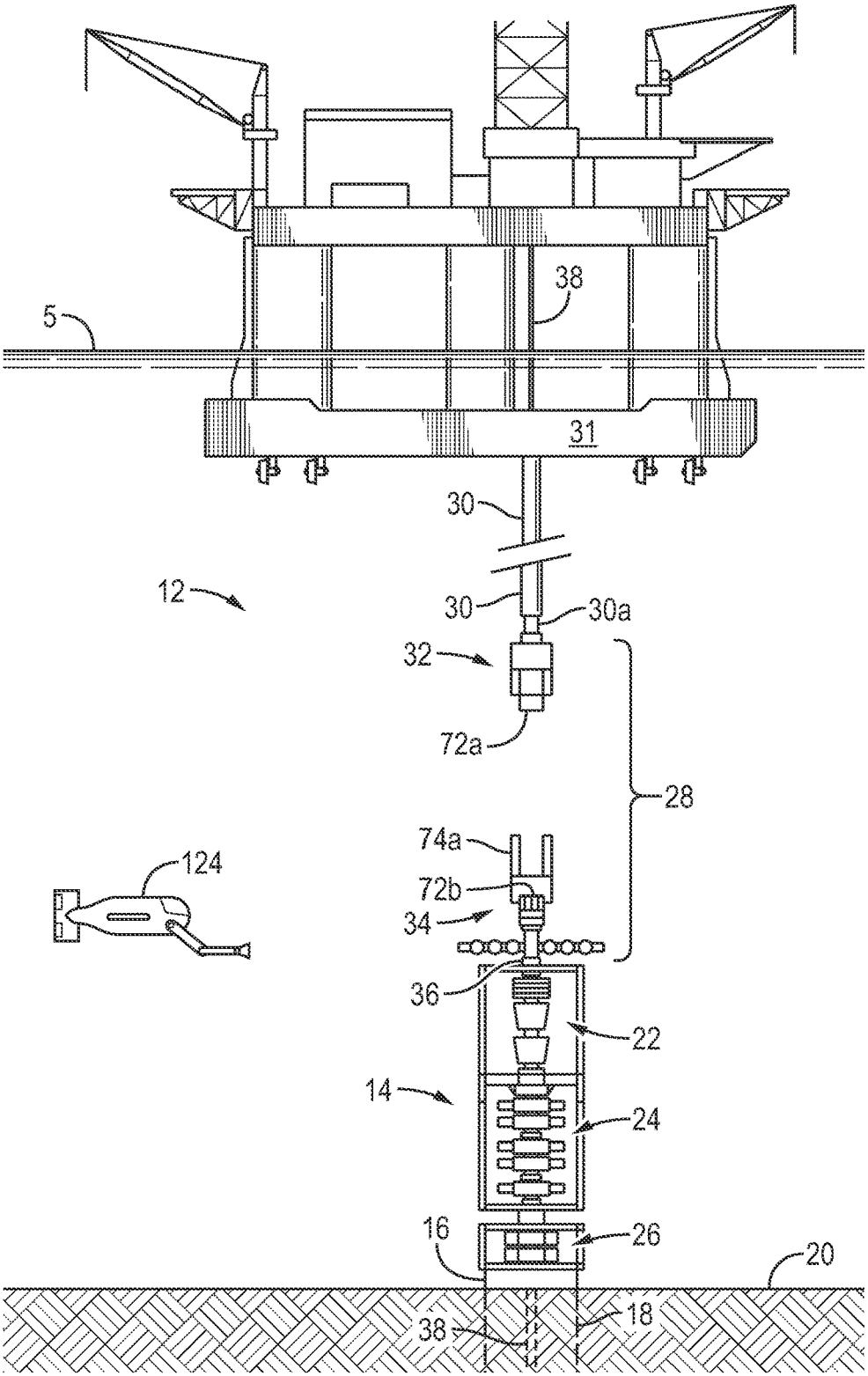

Subsea well safing system 10 comprises safing package, or assembly, referred to herein as a catastrophic safing package ("CSP") 28 that is landed on BOP system 14 and operationally connects a riser 30 extending from platform 31 (e.g., vessel, rig, ship, etc.) to BOP stack 14 and thus well 18. CSP 28 comprises an upper CSP 32 and a lower CSP 34 that are configured to separate from one another in response to initiation of a safing sequence thereby disconnecting riser 30 from the BOP stack 14 and well 18, for example as illustrated in FIG. 11. The safing sequence is initiated in response to parameters indicating the occurrence of a failure in well 18 with the potential of leading to a blowout of the well. Subsea well safing system 10 may automatically initiate the safing sequence in response to the correspondence of monitored parameters to selected safing triggers. According to one or more embodiments, CSP 28 includes one or more pressure supply devices 1010 (see, e.g., FIGS. 12 and 13) to provide hydraulic pressure on demand to operate one or more of the well system devices (e.g., valves, connectors, ejector bollards, rams, and shears).

Wellhead 16 is a termination of the wellbore at the seafloor and generally has the necessary components (e.g., connectors, locks, etc.) to connect components such as BOPs 24, valves (e.g., test valves, production trees, etc.) to the wellbore. The wellhead also incorporates the necessary components for hanging casing, production tubing, and subsurface flow-control and production devices in the wellbore.

LMRP 22 and BOP stack 14 are coupled together by a connector that is engaged with a corresponding mandrel on the upper end of BOP stack 14. LMRP 22 typically provides the interface (i.e., connection) of the BOPs 24 and the bottom end 30*a* of marine riser 30 via a riser connector 36 (i.e., riser adapter). Riser connector 36 may further comprise one or more ports for connecting fluid (i.e., hydraulic) and electrical conductors, i.e., communication umbilical, which may extend along (exterior or interior) riser 30 from the drilling platform located at surface 5 to subsea drilling system 12. For example, it is common for a well control choke line 44 and a kill line 46 to extend from the surface for connection to BOP stack 14.

Riser 30 is a tubular string that extends from the drilling platform 31 down to well 18. The riser is in effect an extension of the wellbore extending through the water column to drilling vessel 31. The riser diameter is large enough to allow for drill pipe, casing strings, logging tools and the like to pass through. For example, in FIGS. 10 and 11, a tubular 38 (e.g., drill pipe) is illustrated deployed from drilling platform 31 into riser 30. Drilling mud and drill cuttings can be returned to surface 5 through riser 30. Communication umbilical (e.g., hydraulic, electric, optic, etc.) can be deployed exterior to or through riser 30 to CSP 28 and BOP stack 14. A remote operated vehicle ("ROV") 124 is depicted in FIG. 11 and may be utilized for various tasks including installing and removing pressure supply devices 1010.

Figure 12:
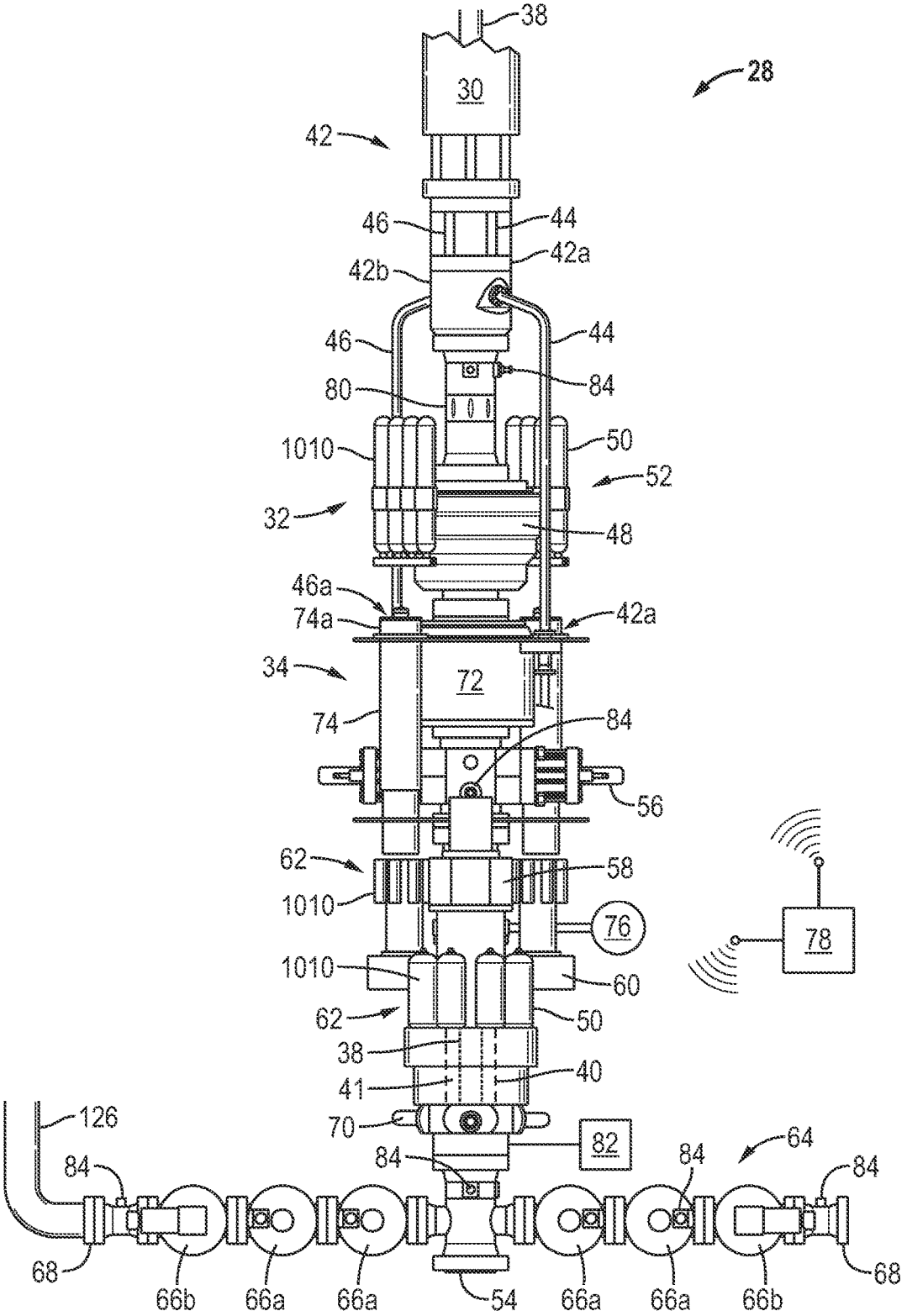
FIG. 12 illustrates a subsea well system incorporating a multiple gas generator driven pressure supply device according to one or more aspects of the disclosure.

Refer now to FIG. 12 which illustrates a subsea well safing package 28 according to one or more embodiments in isolation. CSP 28 depicted in FIG. 12 is further described with reference to FIGS. 10 and 11. In the depicted embodiment, CSP 28 comprises upper CSP 32 and lower CSP 34. Upper CSP 32 comprises a riser connector 42 which may include a riser flange connection 42*a*, and a riser adapter 42*b* which may provide for connection of communication umbilicals and extension of the communication umbilicals to various CSP 28 devices and/or BOP stack 14 devices. For example, a choke line 44 and a kill line 46 are depicted extending from the surface with riser 30 and extending through riser adapter 42*b* for connection to the choke and kill lines of BOP stack 14. CSP 28 comprises a choke stab 44*a* and a kill line stab 46*a* for interconnecting the upper portion of choke line 44 and kill line 46 with the lower portion of choke line 44 and kill line 46. Stabs 44*a*, 46*a* can provide for disconnecting from the stab and kill lines during safing operations; and during subsequent recovery and reentry operations reconnecting to the choke and kill lines via stabs 44*a*, 46*a*. CSP 28 comprises an internal longitudinal bore 40, depicted in FIG. 12 by the dashed line through lower CSP 34, for passing tubular 38. Annulus 41 is formed between the outside diameter of tubular 38 and the diameter of bore 40.

Upper CSP 32 further comprises slips 48 (i.e., safety slips) configured to close on tubular 38. Slips 48 are actuated in the depicted embodiment by hydraulic pressure from a hydraulic accumulator 50 and/or a pressure supply device 1010. In the depicted embodiment, CSP 28 comprises a plurality of hydraulic accumulators 50 and/or pressure supply devices 1010 which may be interconnected in pods, such as upper hydraulic accumulator pod 52. A pressure supply device 1010 located in the upper hydraulic accumulator pod 52 is hydraulically connected to one or more devices, such as slips 48.

Lower CSP 34 comprises a connector 54 to connect to BOP stack 14, for example, via riser connector 36, rams 56 (e.g., blind rams), high energy shears 58, lower slips 60 (e.g., bi-directional slips), and a vent system 64 (e.g., valve manifold). Vent system 64 comprises one or more valves 66. In this embodiment, vent system 64 comprise vent valves (e.g., ball valves) 66*a*, choke valves 66*b*, and one or more connection mandrels 68. Valves 66*b* can be utilized to control fluid flow through connection mandrels 68. For example, a recovery riser 126 is depicted connected to one of mandrels 68 for flowing effluent from the well and/or circulating a kill fluid (e.g., drilling mud) into the well.

In the depicted embodiment, lower CSP 34 further comprises a deflector device 70 (e.g., impingement device, shutter ram) disposed above vent system 64 and below lower slips 60, shears 58, and blind rams 56. Lower CSP 34 includes a plurality of hydraulic accumulators 50 and/or pressure supply devices 1010 arranged and connected in one or more lower hydraulic pods 62 for operations of various devices of CSP 28. In the embodiment of FIG. 12, a chemical source 76, e.g., methanol is illustrated for injection into the system for example to prevent hydrate formation.

Upper CSP 32 and lower CSP 34 are detachably connected to one another by a connector 72. In FIG. 11, the illustrated connector 72 includes a first connector portion 72*a* disposed with the upper CSP 32 and a second connector portion 72*b* disposed with the lower CSP 34. An ejector device 74 (e.g., ejector bollards) is operationally connected between upper CSP 32 and lower CSP 34 to separate upper CSP 32 and riser 30 from lower CSP 34 and BOP stack 14 after connector 72 has been actuated to the unlocked position. Ejector device 74 can be actuated by operation of pressure supply device 1010.

CSP 28 includes a plurality of sensors 84 which can sense various parameters, such as and without limitation, temperature, pressure, strain (tensile, compression, torque), vibration, and fluid flow rate. Sensors 84 further includes, without limitation, erosion sensors, position sensors, and accelerometers and the like. Sensors 84 can be in communication with one or more control and monitoring systems, for example forming a limit state sensor package.

According to one or more embodiments of the invention, CSP 28 comprises a control system 78 which may be located subsea, for example at CSP 28 or at a remote location such as at the surface. Control system 78 may comprise one or more controllers which are located at different locations. For example, in at least one embodiment, control system 78 comprise an upper controller 80 (e.g., upper command and control data bus) and a lower controller 82 (e.g., lower command and controller bus). Control system 78 may be connected via conductors (e.g., wire, cable, optic fibers, hydraulic lines) and/or wirelessly (e.g., acoustic transmission) to various subsea devices (e.g., pressure supply devices 1010) and to surface (i.e., drilling platform 31) control systems.

Figure 13:
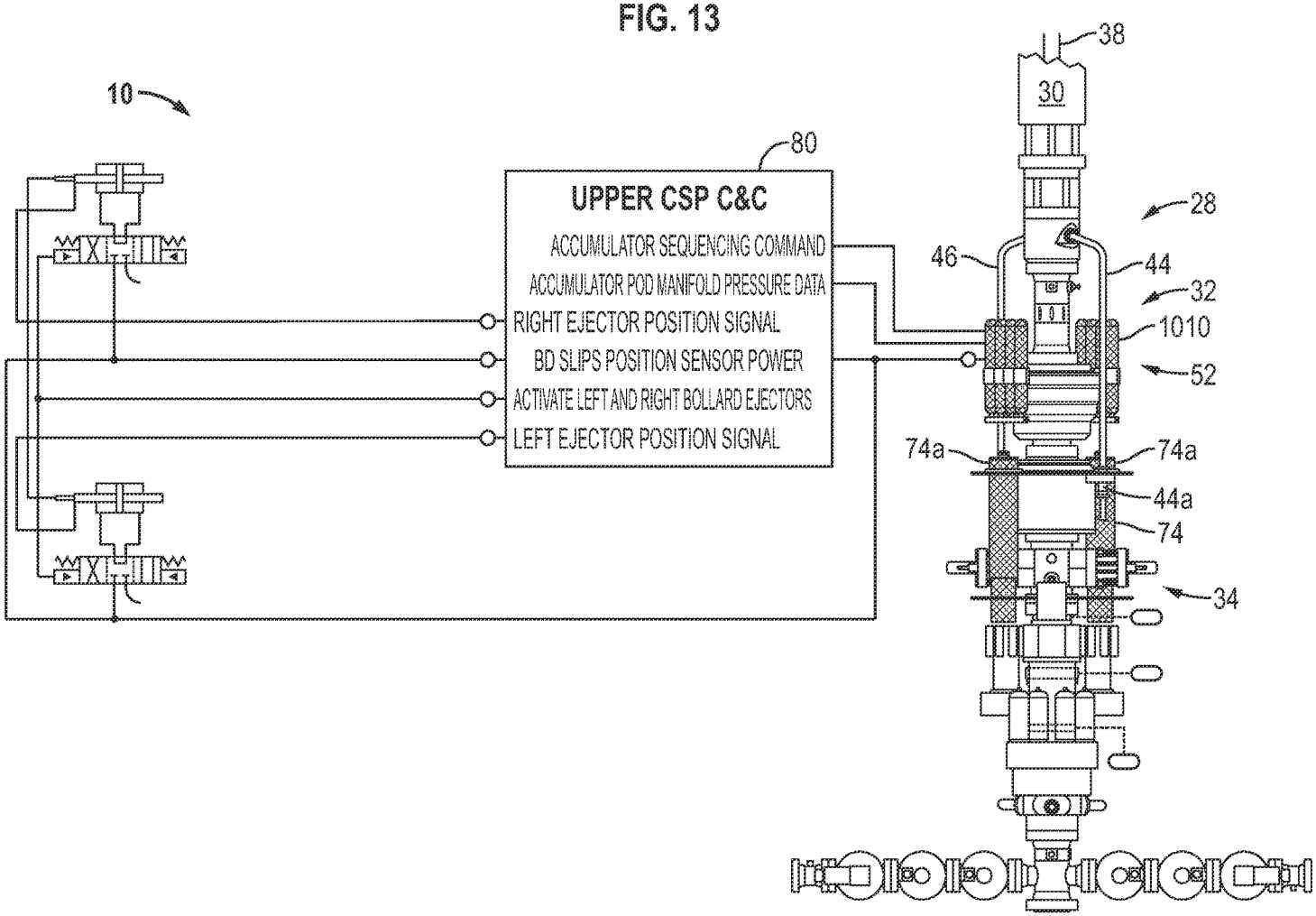
FIG. 13 is a schematic diagram illustrating operation of a multiple gas generator driven pressure supply device according to one or more aspects of the disclosure.

FIG. 13 is a schematic diagram of sequence step, according to one or more embodiments of subsea well safing system 10 illustrating operation of ejector devices 74 (i.e., ejector bollards) to physically separate upper CSP 32 and riser 30 from lower CSP 34 as depicted in FIG. 11. For example, ejector devices 74 may include piston rods 74*a* which extend to push the upper CSP 32 away from lower CSP 34 in the depicted embodiment. FIG. 11 illustrates piston rod 74*a* in an extended position. In the embodiment of FIG. 13, actuation of ejector devices 74 is provided by upper controller 80 sending a signal activating a multiple gas driven pressure supply device 1010 located for example in upper accumulator pod 52 to direct the operating pressure via pressurized hydraulic fluid to ejector devices 74 (i.e., operational device). In accordance to an embodiment, the ejector devices 74 may be actuated in response to receiving a first volume of pressurized hydraulic fluid that is discharged from a pressure supply device 1010 by ignition of a single gas generator. In some embodiments, operation of the ejector devices may require receiving pressurized hydraulic fluid in response to the ignition of more than one of the gas generators of a single pressure supply device; for example the two or more gas generators may be ignited simultaneously or in sequence. In some embodiments, the ejector devices may be actuated to a first position in response to ignition of a first gas generator and actuated to a second position in response to receiving a hydraulic signal from ignition of a second gas generator.

Referring also to FIGS. 1-9, an electronic signal is transmitted from controller 80 and received at one or more of the gas generators 1026. The firing signal may be an electrical or hydraulic pulse and/or coded signal. In response to receipt of the firing signal, the ignitor ignites the pyrotechnic charge, e.g., solid propellant, thereby generating gas 1082 that drives the piston toward the discharge end thereby pressurizing hydraulic fluid 1036 and discharging a volume of pressurized hydraulic fluid through discharge port to the operation device, e.g., ejector devices 74. If the first gas generator does not ignite or otherwise fails, a second gas generator can be ignited to discharge the hydraulic fluid as needed. In accordance to some embodiments a second gas generator 1026 can be operated to advance the stroke of the piston and discharge an additional volume of hydraulic fluid as need to actuate the operation device, for example to actuate the operated device to an additional position. Similarly, as described above with reference to FIG. 4, one or more of the multiple gas generator pressure supply devices 1010 may be actuated to operate another one of the well system operational devices 1100 such as, and without limitation to, valves, slips, rams, shears and locks.

Figure 14:
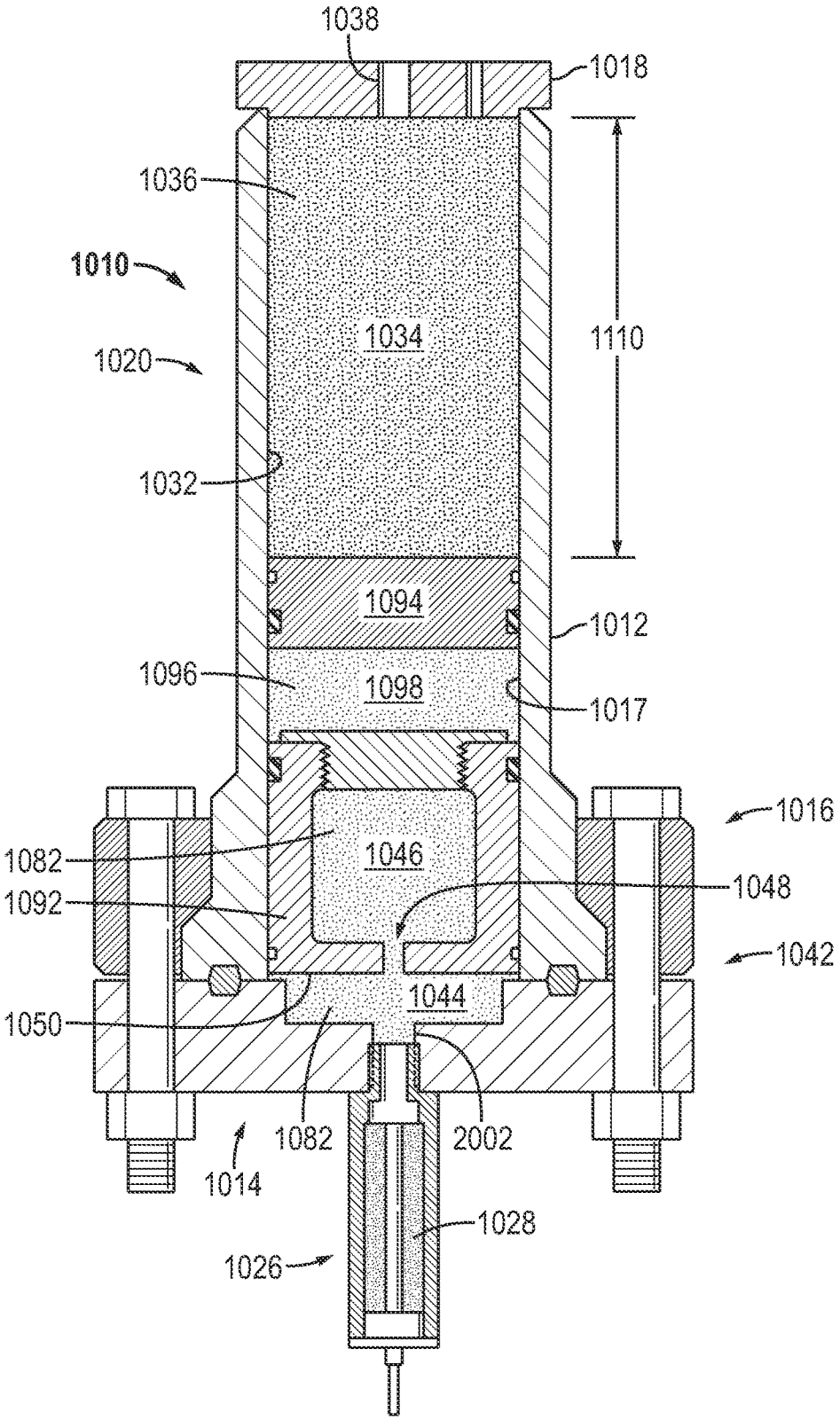
FIGS. 14 to 16 illustrate gas driven pressure supply devices according to one or more aspects of the disclosure having a pair of pistons separated by a compressible medium.
Figure 15:
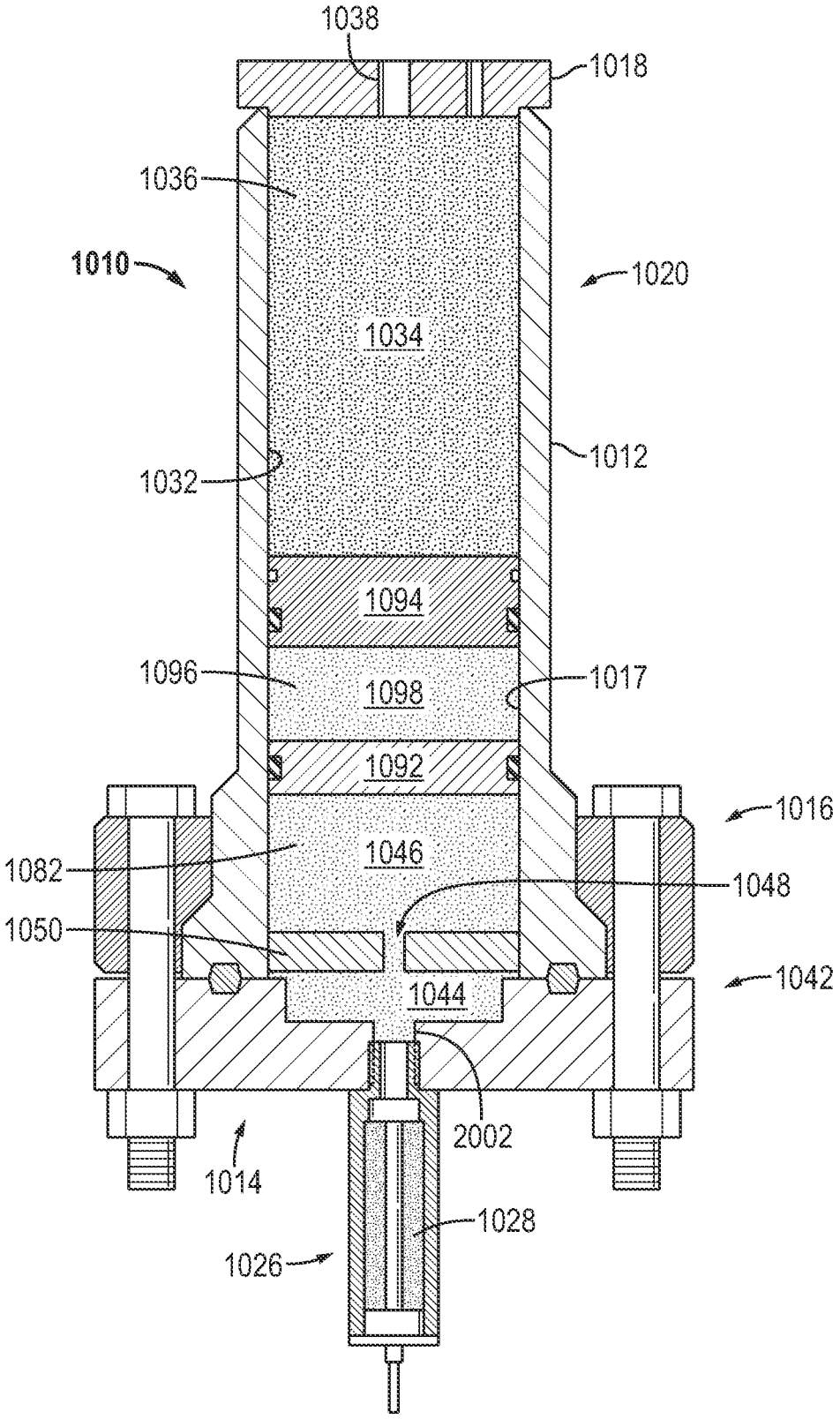
Figure 16:
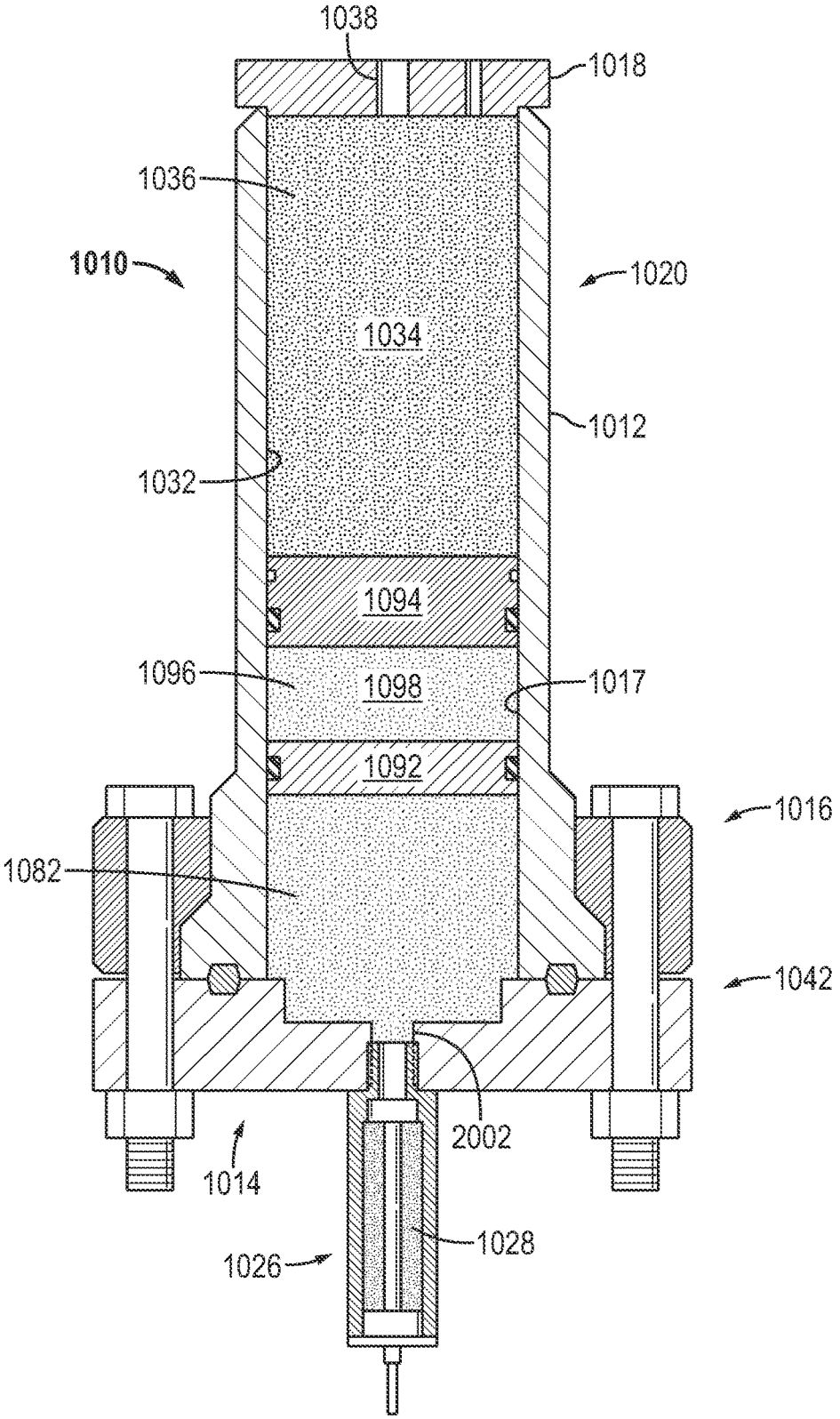

Refer now to FIGS. 14-16 illustrating aspects of pressure supply devices 1010 according to one or more embodiments of this disclosure. As will be understood by those skilled in the art with benefit of this disclosure, pressure supply devices 1010 illustrated in FIGS. 14-16 dampen the initial pressure pulse produced by the propellant 1028 of the gas generator to mitigate or eliminate the pressure shock in the hydraulic chamber 1034 and to the hydraulic circuit and to the downstream operated hydraulic device. FIGS. 14-16 illustrate non-limiting aspects of pressure supply devices in accordance to this disclosure.

The pressure supply devices 1010 illustrated in FIGS. 14-16 each include a pair of pistons 1092, 1094 moveably disposed in the bore 1032 of body 1012. Pistons 1092, 1094 are separated by a compressible medium or fluid 1096, for example silicon. Compressible medium 1096 is disposed in bore 1032 in a space 1098 between the first piston 1092 and the second piston 1094. The first piston 1092 separates the gas chamber 1017 from the compressible medium 1096 and space 1098. Second piston 1094 separates the hydraulic chamber 1034 and incompressible hydraulic fluid 1036 from the compressible medium 1096 and space 1098.

With reference to FIG. 14, gas generator 1026 is connected at an inlet port 2002 to discharge pressurized gas 1082 when it is actuated (e.g., propellant 1028 burns) into the gas chamber 1017. In the embodiment illustrated in FIG. 14, pressurized gas enters the gas chamber 1017 for example in a first portion or breech chamber 1044. A snubbing chamber 1046 is formed by the first piston 1092 and is in communication with the gas chamber 1044 through an orifice 1048. Orifice 1048 is provided for example through a barrier wall 1050 of the first piston oriented toward the first end 1014. The hydraulic output pressure can be controlled for example by adjusting the size of orifice 1048 (e.g., pressure control device). As will be understood by those skilled in the art with benefit of this disclosure, one or more additional pressure control devices can be positioned between first end 1014 and first piston 1092. The first piston and orifice 1048 dampens the pressurization of snubbing chamber 1046. The pressurized gas 1082 acts on first piston 1092 which pressurizes the compressible medium 1096. Pressurizing the compressible medium 1096 dampens the pressure pulse due to the ignition of propellant 1028 and may also provide energy storage to pressurize the hydraulic chamber 1034. The second piston 1094 pressurizes the hydraulic fluid 1036 to actuate the hydraulic circuit. The energy stored in the compressible medium may be released to act on the second piston to provide a continuous or substantially constant discharge pressure through the full stroke length 1110 of the second piston 1094, i.e., pressure supply device 1010.

FIG. 15 illustrates an embodiment of a pressure supply device 1010 in accordance to one or more embodiments of the disclosure. In FIG. 11 a snubbing chamber 1046 is formed between first piston 1092 and pressure control device 1042. Pressure control device 1042 includes a barrier 1050 positioned across bore 1032 between first end 1014 and the first piston 1092. An orifice 1048 is provided through barrier 1050.

FIG. 16 illustrates an embodiment of a pressure supply device 1010 in accordance to one or more embodiments. In FIG. 16 a pressure control device is not positioned between the gas generator at inlet port 2002 and the first piston 1092. It is noted that inlet port 2002 may be utilized to throttle the produced pressurized gas 1082. Additionally, the size of gas chamber 1017 may serve as a buffer volume to dampen the pressure pulse due to the ignited propellant. For example, the volume of gas chamber 1017 may be increased to dampen the pressure pulse acting on the hydraulic fluid and chamber.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method of actuating a hydraulically operated device, comprising:

exhausting, in response to a demand to actuate the hydraulically operated device, a first volume of pressurized hydraulic fluid through a discharge port of a pressure supply device in response to igniting a first gas generator of two or more gas generators, wherein the pressure supply device comprises:

an elongated body having an internal bore extending from a power end to a discharge end having the discharge port, the two or more gas generators connected to the power end, and hydraulic fluid disposed in the internal bore between a piston and the discharge end;

exhausting, in response to a demand to actuate the hydraulically operated device, a second volume of pressurized hydraulic fluid through the discharge port in response to igniting a second gas generator of the two or more gas generators;

actuating the hydraulically operated device to a first position in response to receiving the first volume of pressurized hydraulic fluid; and actuating the hydraulically operated device to a second position in response to receiving the second volume of pressurized hydraulic fluid.

2. The method of claim 1, wherein the first and the second gas generators comprise a propellant that produces a gas in response to being ignited.

3. The method of claim 1, wherein the first and second gas generators are connected directly to the power end.

4. The method of claim 1, wherein the first and the second gas generators are connected to the power end through a conduit.

5. The method of claim 1, wherein:

the first and the second gas generators comprise a propellant that produces a gas in response to being ignited; and the first and second gas generators are connected directly to the power end.

6. The method of claim 1, wherein:

the first and the second gas generators comprise a propellant that produces a gas in response to being ignited; and the first and the second gas generators are connected to the power end through a conduit.

7. The method of claim 1, wherein the hydraulically operated device is a valve.

8. The method of claim 1, wherein the hydraulically operated device is connected in a well system.

9. The method of claim 1, comprising a one-way valve connected between the discharge port and the hydraulically operated device.

10. The method of claim 1, wherein the piston separates a hydraulic chamber formed between the piston and the discharge end and a gas expansion chamber on an opposite side of the piston, the hydraulic fluid disposed in the hydraulic chamber.

11. The method of claim 1, wherein the hydraulically operated device is located subsea.

12. The method of claim 1, wherein the hydraulically operated device is a ram.

13. The method of claim 1, comprising a one-way valve connected between the discharge port and the hydraulically operated device; and the piston separating a hydraulic chamber formed between the piston and the discharge end and a gas expansion chamber formed between the piston and the power end, the hydraulic fluid disposed in the hydraulic chamber.

14. The method of claim 1, wherein the exhausting the first volume of pressurized hydraulic fluid comprises driving the piston toward the discharge end in response to a gas produced by the igniting the first gas generator; and the exhausting the second volume of pressurized hydraulic fluid comprises driving the piston toward the discharge end in response to a gas produced by the igniting the second gas generator.

15. The method of claim 14, wherein the hydraulically operated device is connected in a well system.

16. The method of claim 1, wherein the piston separates a hydraulic chamber formed between the piston and the discharge end and a gas expansion chamber formed between the piston and the power end, the hydraulic fluid disposed in the hydraulic chamber;

the exhausting the first volume of pressurized hydraulic fluid comprises driving the piston toward the discharge end in response to a gas produced by the igniting the first gas generator being communicated into the gas expansion chamber; and the exhausting the second volume of pressurized hydraulic fluid comprises driving the piston toward the discharge end in response to a gas produced by the igniting the second gas generator being communicated into the gas expansion chamber.

17. The method of claim 16, wherein the hydraulically operated device is connected in a well system.

18. The method of claim 16, wherein the hydraulically operated device is a ram.

19. The method of claim 1, comprising a one-way valve connected between the discharge port and the hydraulically operated device;

the piston separating a hydraulic chamber formed between the piston and the discharge end and a gas expansion chamber formed between the piston and the power end, the hydraulic fluid disposed in the hydraulic chamber;

the exhausting the first volume of pressurized hydraulic fluid comprises driving the piston toward the discharge end in response to a gas produced by the igniting the first gas generator being communicated into the gas expansion chamber; and the exhausting the second volume of pressurized hydraulic fluid comprises driving the piston toward the discharge end in response to a gas produced by the igniting the second gas generator being communicated into the gas expansion chamber.

20. The method of claim 19, wherein the hydraulically operated device is connected in a well system.

* * * * *